US009455511B1

(12) United States Patent
Taguchi

(10) Patent No.: US 9,455,511 B1
(45) Date of Patent: Sep. 27, 2016

(54) CIRCUIT BOARD CONNECTING DEVICE

(71) Applicant: DAI-ICHI SEIKO CO., LTD., Kyoto (JP)

(72) Inventor: Satoru Taguchi, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/054,715

(22) Filed: Feb. 26, 2016

(30) Foreign Application Priority Data

Mar. 18, 2015 (JP) ..... 2015-55063

(51) Int. Cl.
*H01R 12/00* (2006.01)
*H01R 12/71* (2011.01)

(52) U.S. Cl.
CPC ..... *H01R 12/716* (2013.01)

(58) Field of Classification Search
USPC ..... 439/74, 607.09
See application file for complete search history.

(56) References Cited

U.S. PATENT DOCUMENTS 7,207,842 B1 * 4/2007 Kenjo ..... H01R 9/0515 439/607.01
8,647,129 B2 * 2/2014 Takahashi ..... H01R 12/718 439/513
8,834,183 B2 * 9/2014 Komoto ..... H01R 12/71 439/507
2008/0026609 A1 * 1/2008 Kuwana ..... H01R 12/716 439/74

FOREIGN PATENT DOCUMENTS

JP H10-172685 A 6/1998
JP 2008-218095 9/2008

* cited by examiner

*Primary Examiner* — Tho D Ta
(74) *Attorney, Agent, or Firm* — Studebaker & Brackett PC

(57) ABSTRACT

A circuit board connecting device comprising a first connector mounted on a first circuit board and having a first housing with an engaging recess, first signal contacts each having a first contacting portion and a first board connecting portion and a conductive shell for covering an outer peripheral surface of the first housing surrounding the engaging recess, and a second connector mounted on a second circuit board and having a second housing operative to be put in the engaging recess and second signal contacts each having a second contacting portion and a second board connecting portion, wherein when the second housing is put in the engaging recess, the second contacting portion of each of the second signal contacts is in contact with the first contacting portion of a corresponding one of the first signal contacts and the first and second signal contacts are surrounded by the conductive shell.

6 Claims, 11 Drawing Sheets

CIRCUIT BOARD CONNECTING DEVICE

BACKGROUND OF THE INVENTION

1. Field of the Invention

The present invention relates generally to a circuit board connecting device, and more particularly to an improvement in a circuit board connecting device which is used for putting a pair of separate circuit boards in mutual electrical connection.

2. Description of the Prior Art Including Information Disclosed Under 37 CFR 1.97 and 37 CFR 1.98

Various kinds of electric or electronic parts are built even in a relatively small-sized electronic apparatus such as a mobile phone or the like. A major part of those parts are dispersedly mounted on, for example, a pair of separate circuit boards to fulfill their respective functions. In the relatively small-sized electronic apparatus, having an eye to the pair of separate circuit boards on which the electric or electronic parts are mounted, it is likely that the separate circuit boards are required to be arranged so as to reduce a space occupied thereby when the separate circuit boards are electrically connected with each other in a limited inside space of the apparatus.

In general, when a plurality of circuit boards, such as solid circuit boards or flexible printed circuit boards, are electrically connected with one another, a plurality of electrical connectors are mounted respectively on the circuit boards and one of the electrical connectors is coupled with another electrical connector so as to connect one of the circuit boards electrically with another circuit board. In the case where two separate circuit boards are electrically connected with each other, first and second electrical connectors are mounted respectively on the separate circuit boards to be coupled with each other. Each of the first and second electrical connectors is provided with, for example, a housing made of insulating material to be fixed to the separate circuit board and a plurality of signal contacts held by the housing so as to be electrically connected respectively with a plurality of signal terminals provided on the separate circuit board. Then, when the housing of the first electrical connector mounted on one of the separate circuit boards is engaged with the housing of the second electrical connector mounted on the other of the separate circuit boards so that the first and second electrical connectors are coupled with each other, the signal contacts held by the housing of the first electrical connector are connected respectively with the signal contacts held by the housing of the second electrical connector and thereby the signal terminals provided on one of the separate circuit boards are electrically connected respectively with the signal terminals provided on the other of the separate circuit boards through the signal contacts of the first and second electrical connectors.

Under a situation in which two separate circuit boards are electrically connected with each other in such a manner as mentioned above, in particular each of the separate circuit boards is used for managing high-frequency signals, the first and second electrical connectors mounted respectively on the circuit boards to be coupled with each other are desired to be put in an electromagnetically shielded condition wherein undesirable output electromagnetic wave noises leaking out of each of the first and second electrical connectors and undesirable input electromagnetic wave noises reaching from the outside to each of the first and second electrical connectors are reduced as much as possible. Therefore, there have been previously proposed several electrical connectors used for connecting two circuit boards with each other and provided with electromagnetic shielding means for making the electromagnetically shielded condition, as disclosed in, for example, the Japanese patent application published before examination under publication number H10-172685 (hereinafter, referred to as published prior art document 1) and the Japanese patent application published before examination under publication number 2008-218095 (hereinafter, referred to as published prior art document 2).

An electrical connector disclosed in the published prior art document 1 comprises a housing (an insulator (1)) made of insulating material to have a coupling portion (1*a*) for coupling with a mate electrical connector and to be fixed to a circuit board (a board (7)) so that the electrical connector is mounted on the circuit board, a plurality of signal contacts (contacts (3)) arranged on the housing, each of which has a contacting portion (3*a*) for coming into contact with a signal contact of the mate electrical connector and a connecting end portion (3*b*) for connecting with a signal terminal on the circuit board, and a conductive shell (5) fastened to the circuit board so as to cover wholly the housing mounted on the circuit board and the connecting end portions (3*b*) of the signal contacts at the outside of the housing on the circuit board. The contacting portion (3*a*) of each of the signal contacts is put in the coupling portion (1*a*) formed on the housing and the connecting end portion (3*b*) of each of the signal contacts projects to the outside from the housing to be soldered to the signal terminal on the circuit board. The conductive shell (5) is connected with a grounding terminal on the circuit board.

The coupling portion (1*a*) formed on the housing is coupled with the mate electrical connector fixed to another circuit board other than the circuit board to which the housing is fixed, so that each of the contacting portions (3*a*) of the signal contacts put in the coupling portion (1*a*) comes into contact with the signal contact of the mate electrical connector and the circuit board to which the housing is fixed and the circuit board on which the mate electrical connector is fixed are connected with each other. Under such a condition, the conductive shell (5) which is provided for covering wholly the housing mounted on the circuit board and the connecting end portions (3*b*) of the signal contacts at the outside of the housing on the circuit board, functions as electromagnetic shielding means to the electrical connector mounted on the circuit board.

Then, an electrical connector (a receptacle connector (1)) disclosed in the published prior art document 2 comprises a housing (a receptacle housing (3)) provided with a coupling portion (a receptacle coupling portion (32)) for coupling with a mate coupling portion (a plug coupling portion (142)) of a mate electrical connector (a plug connector (12)) and fixed to a circuit board (a first printed circuit board (21)) so that the electrical connector is mounted on the circuit board, a plurality of contacts (receptacle contacts (5)) including a plurality of receptacle signal contacts (5S), each of which is provided with an end portion (5*d*) to be connected with a signal terminal (a signal pad (21*a*)) on the circuit board and operative to contact with a mate signal contact (a plug contact (16)) of the mate electrical connector, and a conductive shell (7) attached to a outer peripheral surface of the housing to have a shell body (71) surrounding the coupling portion of the housing. A portion of each of the receptacle signal contacts (5S) is put in the coupling portion of the housing and the end portion (5*d*) of the receptacle signal contacts (5S) projects to the outside from the housing to be soldered to the signal terminal on the circuit board. The conductive shell (7) is connected with a grounding pad (21*b*) on the circuit board.

The coupling portion formed on the housing is coupled with the mate coupling portion of the mate electrical connector fixed to another circuit board other than the circuit board to which the housing is fixed, so that the portion of each of the receptacle signal contacts (5S) put in the coupling portion comes into contact with the mate signal contact of the mate electrical connector and the circuit board to which the housing is fixed and the circuit board to which the mate electrical connector is fixed are connected with each other. Under such a condition, the conductive shell (7) attached to the outer peripheral surface of the housing functions as an electromagnetic shielding means to the electrical connector mounted on the circuit board.

In each of the previously proposed electrical connectors used for connecting a pair of circuit boards with each other as described above, there are the following defects or disadvantages.

In the case of the electrical connector disclosed in the published prior art document 1, the housing and the conductive shell functioning as the electromagnetic shielding means are separately provided to be discriminated parts. When the housing and the conductive shell are mounted on the circuit board, first the housing on which the contacts are arranged is put on the circuit board and the connecting end portions of the signal contacts projecting to the outside from the housing are soldered to the signal terminals of the circuit board so that the housing is fixed to the circuit board, and then the conductive shell is fastened to the housing so as to cover wholly the housing mounted on the circuit board and the connecting end portions of the signal contacts at the outside of the housing on the circuit board. Consequently, separate processes of working are required respectively to fix the housing with the signal contacts arranged thereon to the circuit board and to fasten the conductive shell covering the housing to the circuit board, so that a total process of working for mounting the electric connector on the circuit board becomes complicated and troublesome.

Further, in the case of the electrical connector disclosed in the published prior art document 2, the conductive shell functioning as the electromagnetic shielding means is provided to be attached to the outer peripheral surface of the housing to have the shell body surrounding the coupling portion of the housing so as to be unable to cover the end portions of the receptacle signal contacts projecting to the outside from the housing to be soldered to the signal terminals on the circuit board. Consequently, the end portions of the receptacle signal contacts soldered to the signal terminals on the circuit board are not put in the electromagnetically shielded condition brought about by the conductive shell so that undesirable output electromagnetic wave noises leaking out of the end portions of the receptacle signal contacts and undesirable input electromagnetic wave noises reaching from the outside to the end portions of the receptacle signal contacts cannot be reduced. That is, in the electrical connector having the receptacle signal contacts is not electromagnetically shielded enough.

BRIEF SUMMARY OF THE INVENTION

Accordingly, it is an object of the present invention to provide a circuit board connecting device used for putting a pair of separate circuit boards in mutual electrical connection, which includes a pair of electrical connectors provided to be mounted respectively on the separate circuit boards and an electromagnetic shielding member, and in which each of the electrical connectors is operative to avoid the aforementioned problems and disadvantages encountered with the prior art.

Another object of the present invention is to provide a circuit board connecting device used for putting a pair of separate circuit boards in mutual electrical connection, which includes a pair of electrical connectors provided to be mounted respectively on the separate circuit boards and an electromagnetic shielding member, and by which a total process of working for mounting each of the electric connectors respectively on the separate circuit boards is able to be prevented from being complicated and troublesome.

A further object of the present invention is to provide a circuit board connecting device used for putting a pair of separate circuit boards in mutual electrical connection, which includes a pair of electrical connectors provided to be mounted respectively on the separate circuit boards and an electromagnetic shielding member, and in which the electrical connectors are able to be electromagnetically shielded enough with relatively simple structure.

According to the present invention, there is provided a circuit board connecting device for putting first and second separate circuit boards in mutual electrical connection, which comprises a first electrical connector provided to be mounted on the first separate circuit board, said first electrical connector having a first housing provided thereon with an engaging recess with a bottom portion on which a first through hole is formed, a plurality of first signal contacts provided on the first housing, each of which has a first contacting portion fixed to a recess forming portion of the first housing in which the engaging recess is formed and a first board connecting portion put in the first through hole to be connected with the first separate circuit board, and a conductive shell provided for covering wholly an outer peripheral surface of the first housing surrounding the engaging recess; and a second electrical connector provided to be mounted on the second separate circuit board, said second electrical connector having a second housing provided thereon with a second through hole and operative to be put in the engaging recess provided on the first housing so as to engage with the engaging recess, and a plurality of second signal contacts provided on the second housing, each of which has a second contacting portion attached to an outer surface of the second housing and a second board connecting portion put in the second through hole to be connected with the second separate circuit board; wherein when the second housing is put in the engaging recess provided on the first housing so as to engage with the engaging recess, the second contacting portion of each of the second signal contacts is in contact with the first contacting portion of a corresponding one of the first signal contacts and the first and second signal contacts are surrounded by the conductive shell.

In the circuit board connecting device thus constituted in accordance with the present invention, the first electrical connector has the conductive shell provided for covering wholly the outer peripheral surface of the first housing surrounding the engaging recess and the first signal contacts are provided on the first housing in such a manner that each of the first signal contacts has the first contacting portion fixed to the recess forming portion of the first housing in which the engaging recess is formed and the first board connecting portion put in the first through hole formed on the bottom portion of the engaging recess, so that the first signal contacts on the whole are surrounded by the conductive shell. Further, the second housing of the second electrical connector, on which the second signal contacts are provided in such a manner that each of the second signal contacts has the second contacting portion attached to the outer surface of the second housing and the second board connecting portion put in the second through hole formed on the second housing, is operative to be put wholly in the engaging recess provided on the first housing of the first electrical connector so as to engage with the engaging recess.

Then, when the second housing of the second electrical connector is put in the engaging recess provided on the first housing of the first electrical connector so as to engage with the engaging recess, the second contacting portion of each of the second signal contacts is in contact with the first contacting portion of the corresponding one of the first signal contacts and the first and second signal contacts on the whole are surrounded by the conductive shell provided for covering wholly the outer peripheral surface of the first housing surrounding the engaging recess.

Further, the circuit board connecting device according to the present invention is used for connecting electrically a group of signal terminals provided on the first separate circuit board, on which the first electrical connector is mounted, with another group of signal terminals provided on the second separate circuit boards, on which the second electrical connector is mounted, so that the first and second separate circuit boards are electrically connected with each other.

When the first electrical connector is mounted on the first separate circuit boards, the first board connecting portion of each of the first signal contacts of the first electrical connector is connected by, for example, soldering with the signal terminal provided on the first separate circuit board in the first through hole formed on the first housing of the first electrical connector, and when the second electrical connector is mounted on the second separate circuit boards, the second board connecting portion of each of the second signal contacts of the second electrical connector is connected by, for example, soldering with the signal terminal provided on the second separate circuit board in the second through hole formed on the second housing of the second electrical connector. As a result, the first signal contacts of the first electrical connector are electrically connected respectively with the signal terminals provided on the first separate circuit boards and the second signal contacts of the second electrical connector are electrically connected respectively with the signal terminals provided on the second separate circuit boards.

Besides, in an example of circuit board connecting device according to the present invention, the first signal contacts provided on the first housing are arranged in a first predetermined direction and the second signal contacts provided on the second housing are arranged in a second predetermined direction.

With the circuit board connecting device according to the present invention described above, when the second housing of the second electrical connector is put in the engaging recess provided on the first housing of the first electrical connector so as to engage with the engaging recess, the second contacting portion of each of the second signal contacts is in contact with the first contacting portion of the corresponding one of the first signal contacts and the first and second signal contacts on the whole are surrounded by the conductive shell provided for covering wholly the outer peripheral surface of the first housing surrounding the engaging recess. Therefore, the first and second signal contacts having respectively the first and second contacting portions put in mutual contact-connection on the whole can be electromagnetically shielded enough with a relatively simple structure in which the conductive shell is provided on the first connector for covering wholly the outer peripheral surface of the first housing surrounding the engaging recess. This means that the first and second electrical connectors mounted respectively on the first and second separate circuit boards can be electromagnetically shielded enough with the relatively simple structure.

The conductive shell which functions as electromagnetic shielding means for the first and second signal contacts on the whole as mentioned above is incorporated with the first electrical connector so as to cover wholly the outer peripheral surface of the first housing surrounding the engaging recess. That is, the conductive shell is not a discriminated member separated from the first electrical connector. Therefore, when the first electrical connector is mounted on the separate circuit board, for example, such troublesome works as first to fix the first housing to the separate circuit board and then to fasten the conductive shell to the separate circuit board are not required, and a process of working for mounting the first electrical connector on the separate circuit board is prevented from being complicated and troublesome.

Further, the first board connecting portion of each of the first signal contacts of the first electrical connector is able to be connected with the circuit terminal provided on the first separate circuit board by, for example, soldering conducted through the first through hole formed on the first housing of the first electrical connector and the second board connecting portion of each of the second signal contacts of the second electrical connector is also able to be connected with the circuit terminal provided on the second separate circuit board by, for example, soldering conducted through the second through hole formed on the second housing of the second electrical connector. Therefore, a total process of working for mounting the first and second electric connectors respectively on the separate circuit boards is able to be surely prevented from being complicated and troublesome.

As described above, with the circuit board connecting device according to the present invention, in a situation wherein the signal terminals provided on the first separate circuit board, on which the first electrical connector is mounted, and the signal terminals provided on the second separate circuit board, on which the second electrical connector is mounted, are put in mutual electrical connection so that the first and second separate circuit boards are electrically connected with each other by the first and second electrical connector, the total process of working for mounting the first and second electric connectors respectively on the separate circuit boards is able to be prevented from being complicated and troublesome and the first and second electrical connectors are able to be electromagnetically shielded enough with the relatively simple structure.

The above, and other objects, features and advantages of the present invention will become apparent from the following detailed description taken in conjunction with the accompanying drawings.

DETAILED DESCRIPTION OF THE INVENTION

Figure 1:
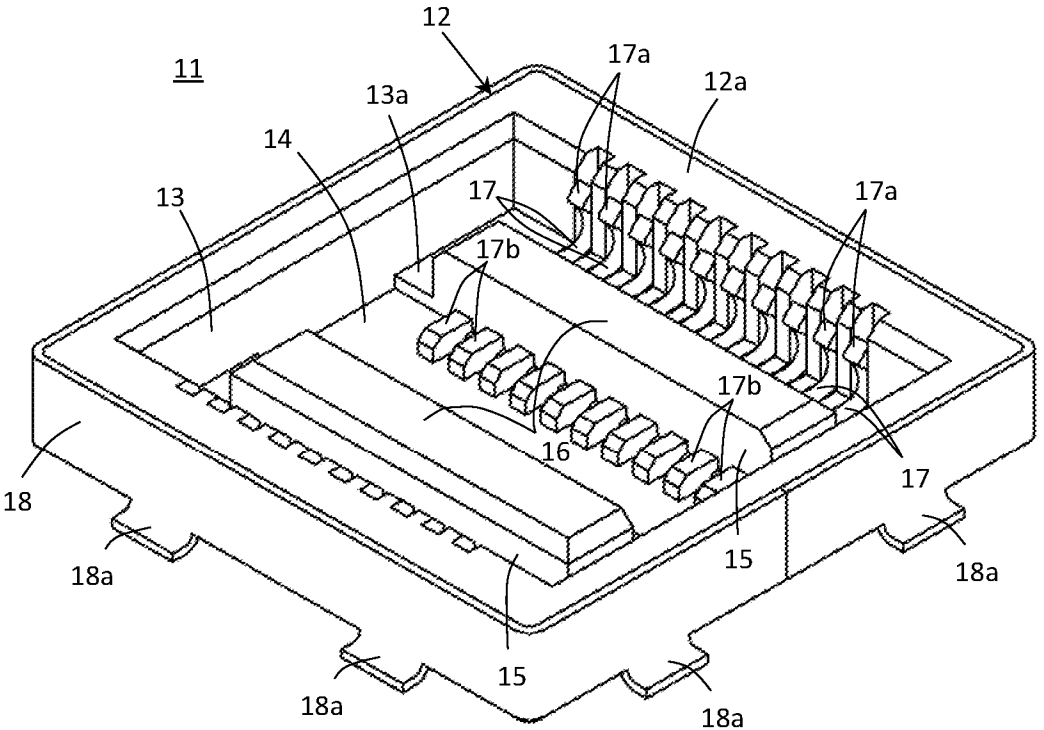
FIG. 1 is a schematic top perspective view showing a receptacle electrical connector included in an embodiment of circuit board connecting device according to the present invention.
Figure 2:
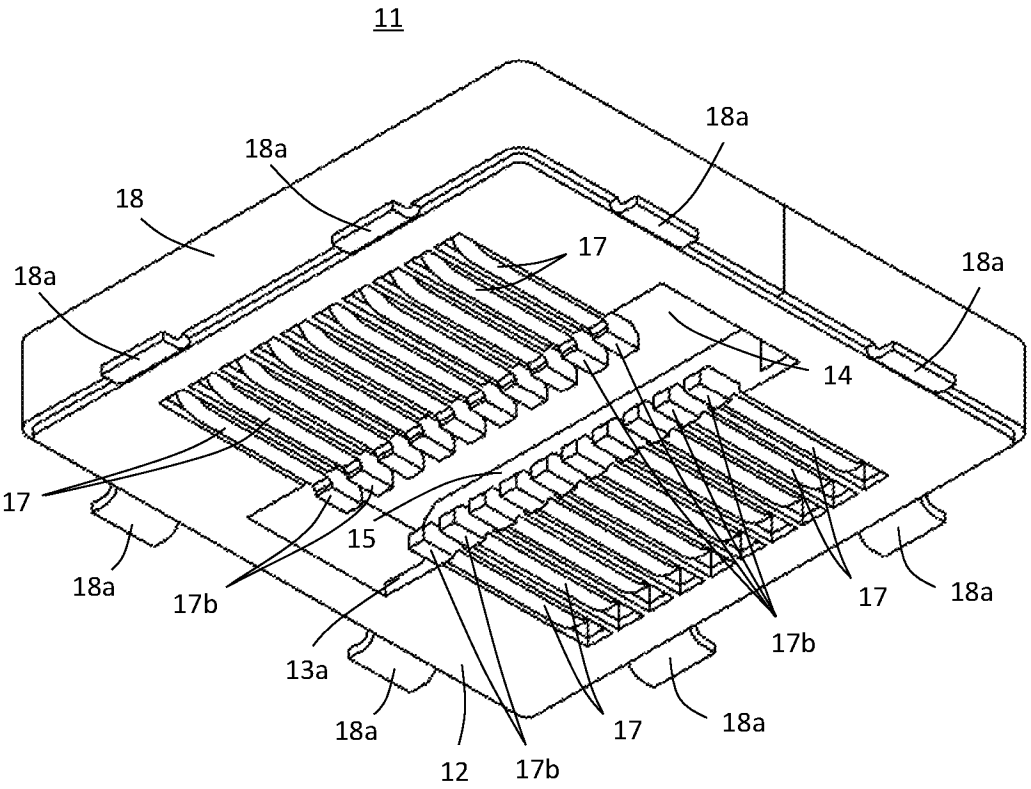
FIG. 2 is a schematic bottom perspective view showing the receptacle electrical connector included in the embodiment of circuit board connecting device according to the present invention.
Figure 3:
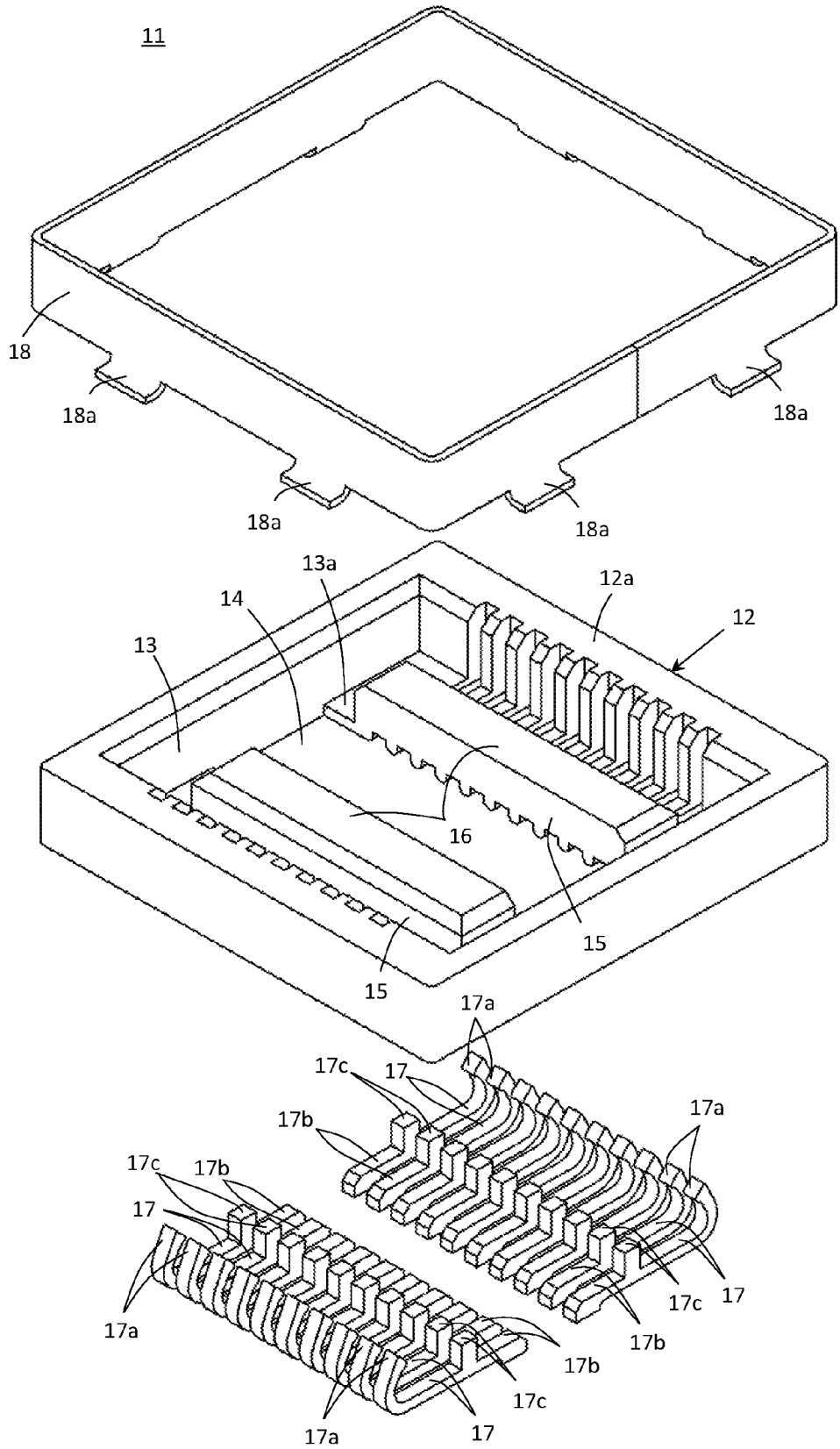
FIG. 3 is a schematic exploded perspective view showing the receptacle electrical connector included in the embodiment of circuit board connecting device according to the present invention.

Each of FIGS. 1 and 2 shows a receptacle electrical connector 11 which constitutes a first electrical connector included in an embodiment of circuit board connecting device according to the present invention, and FIG. 3 is an exploded view showing the receptacle electrical connector 11.

Referring to FIGS. 1 to 3, the receptacle electrical connector 11 has a housing 12 made of insulating material such as plastics or the like to constitute a first housing. The housing 12 is provided thereon with an engaging recess 13 formed into a rectangular shape and a recess forming portion 12*a* shaped into a rectangular frame-like member in which the engaging recess 13 is formed. A rectangular through hole 14 is formed on a bottom portion 13*a* of the engaging recess 13 at a position of a central portion of the housing 12 to constitute a first through hole and a pair of protrusions 15 are also formed on the bottom portion 13*a* of the engaging recess 13 to project from the bottom portion 13*a* into the engaging recess 13. The rectangular through hole 14 is positioned between the protrusions 15 opposite to each other and a contacting face portion 16 is formed on each of the protrusions 15 to constitute a first contacting face portion. Therefore, the contacting face portion 16 is provided to project from the bottom portion 13*a* of the engaging recess 13 into the engaging recess 13.

The receptacle electrical connector 11 has also a plurality of signal contacts 17 fixed to the housing 12 to constitute a plurality of first signal contacts. The signal contacts 17 are divided into first and second groups and the signal contacts 17 belonging to each of the first and second groups are arranged on the housing 12 along a single direction.

Each of the signal contacts 17 is made of resilient conductive material to have a contacting portion 17*a* constituting a first contacting portion, a board connecting portion 17*b* constituting a first board connecting portion, and a fixable portion 17*c* provided between the contacting portion 17*a* and the board connecting portion 17*b*. The contacting portion 17*a* of each of the signal contacts 17 is put in a groove formed on a part of the recess forming portion 12*a* of the housing 12 which constitute one of four sides of the engaging recess 13, the board connecting portion 17*b* of each of the signal contacts 17 projects from one of four sides of the rectangular through hole 14 formed on the bottom portion 13*a* of the engaging recess 13 to be put in the rectangular through hole 14, and the fixable portion 17*c* of each of the signal contacts 17 is buried in the protrusion 15 projecting from the bottom portion 13*a* of the engaging recess 13 to be fixed to the protrusion 15. Accordingly, in the engaging recess 13 provided on the housing 12, the board connecting portion 17*b* of each of the signal contacts 17 belonging to the first group and the board connecting portion 17*b* of each of the signal contacts 17 belonging to the second group are positioned to be opposite to each other in the rectangular through hole 14.

Under such a condition, each of the signal contacts 17 is provided on the recess forming portion 12*a* of the housing 12 and at the inside of the recess forming portion 12*a* so as not to have any part thereof projecting to the outside from the housing 12.

The receptacle electrical connector 11 has further a conductive shell 18 provided for surrounding an outer side surface of the recess forming portion 12*a* of the housing 12 which is shaped into the rectangular frame-like member. The conductive shell 18 is made of conductive plate material to be formed into a rectangular frame-like member for covering wholly an outer peripheral surface of the housing 12 surrounding the engaging recess 13. A plurality of board connecting tongue portions 18*a* are provided on the conductive shell 18.

Figure 4:
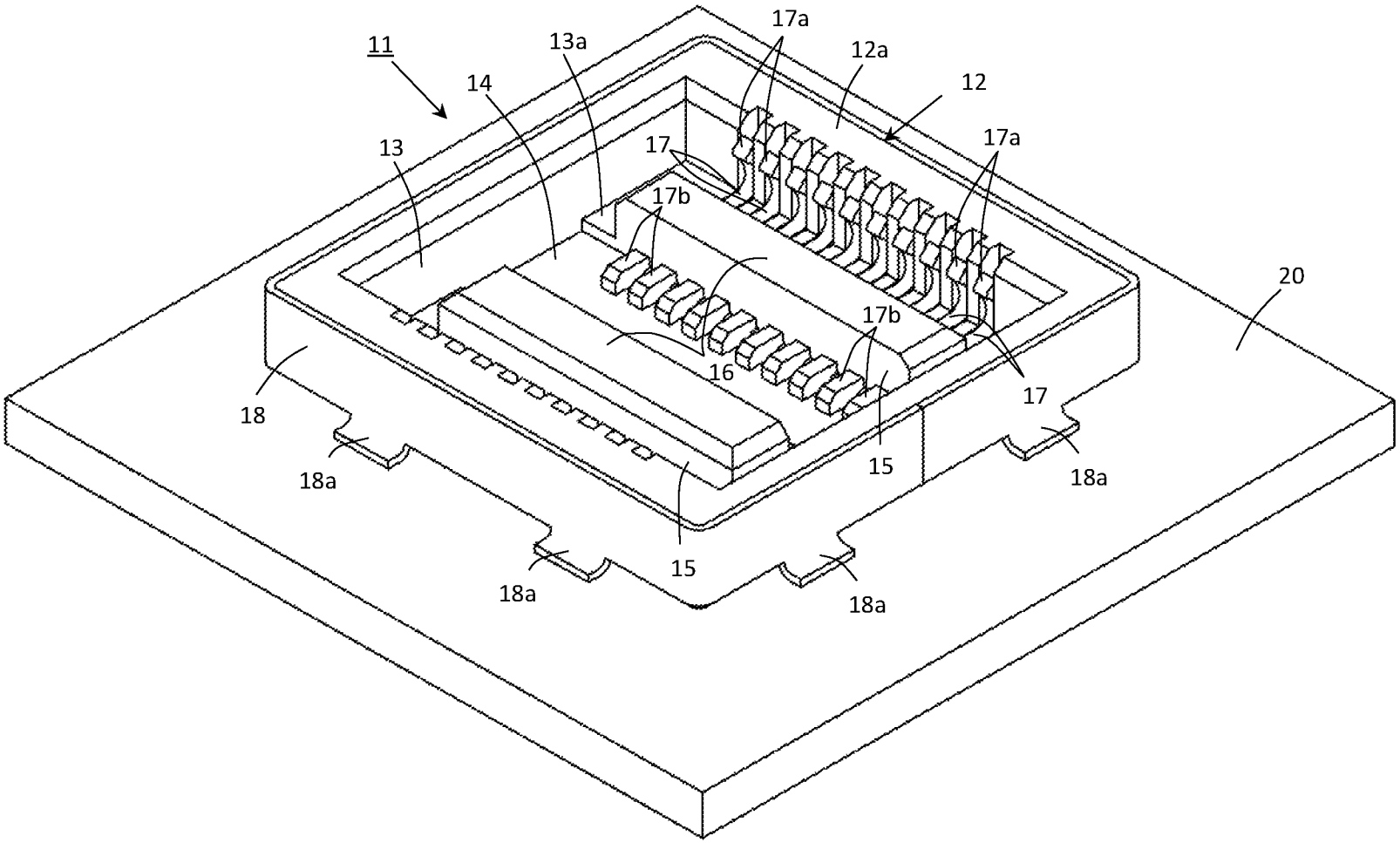
FIG. 4 is a schematic perspective view showing the receptacle electrical connector included in the embodiment of circuit board connecting device according to the present invention, together with a separate circuit board on which the receptacle electrical connector is mounted.
Figure 5:
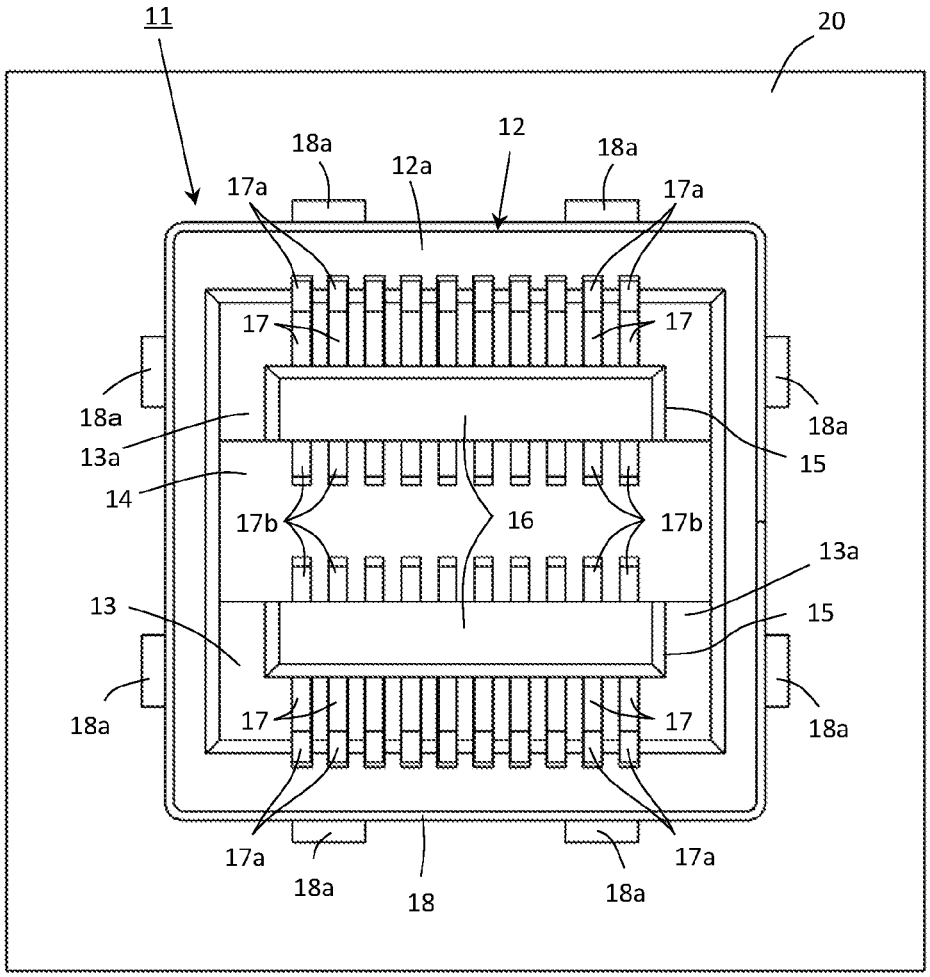
FIG. 5 is a schematic plan view showing the receptacle electrical connector included in the embodiment of circuit board connecting device according to the present invention, together with the separate circuit board on which the receptacle electrical connector is mounted.

The receptacle electrical connector 11 constituted as described above is mounted on a separate circuit board to be put in practical use. Each of FIGS. 4 and 5 shows a condition wherein the receptacle electrical connector 11 is mounted on a separate circuit board 20 constituting a first separate circuit board. When the receptacle electrical connector 11 is in process of mounting on the separate circuit board 20, the housing 12 with the signal contacts 17 arranged thereon to be fixed and the recess forming portion 12*a* having the outer peripheral surface thereof surrounded by the conductive shell 18 is placed on the separate circuit board 20 in such a manner that the board connecting portion 17*b* of each of the signal contacts 17 positioned in the rectangular through hole 14 formed on the bottom portion 13*a* of the engaging recess 13 is in contact with the separate circuit board 20 and then the board connecting portion 17*b* of each of the signal contacts 17 is connected with a signal terminal (not shown in the drawings) provided on the separate circuit board 20 by, for example, soldering in the rectangular through hole 14. Further, each of the board connecting tongue portions 18*a* of the conductive shell 18 covering wholly the outer peripheral surface of the housing 12 surrounding the engaging recess 13 is connected with a grounding portion (not shown in the drawings) provided on the separate circuit board 20 by, for example, soldering at the outside of the housing 12. In such a manner as mentioned above, the board connecting portion 17*b* of each of the signal contacts 17 is connected with the signal terminal provided on the separate circuit board 20 by, for example, soldering and each of the board connecting tongue portions 18*a* of the conductive shell 18 is connected with the grounding portion provided on the separate circuit board 20 by, for example, soldering, so that the receptacle electrical connector 11 on the whole is mounted on the separate circuit board 20 to be fixed to the same.

When the receptacle electrical connector 11 on the whole is fixed to the separate circuit board 20 as mentioned above, the soldering for connecting the board connecting portion 17*b* of each of the signal contacts 17 with the signal terminal provided on the separate circuit board 20 is able to be conducted surely and easily through the rectangular through hole 14 formed on the bottom portion 13*a* of the engaging recess 13 provided on the housing 12. In addition, each of the signal contacts 17 is surrounded by the conductive shell 18 without having any part thereof projecting to the outside from the housing 12 and therefore the signal contacts 17 on the whole are able to be electromagnetically shielded enough by the conductive shell 18.

Figure 6:
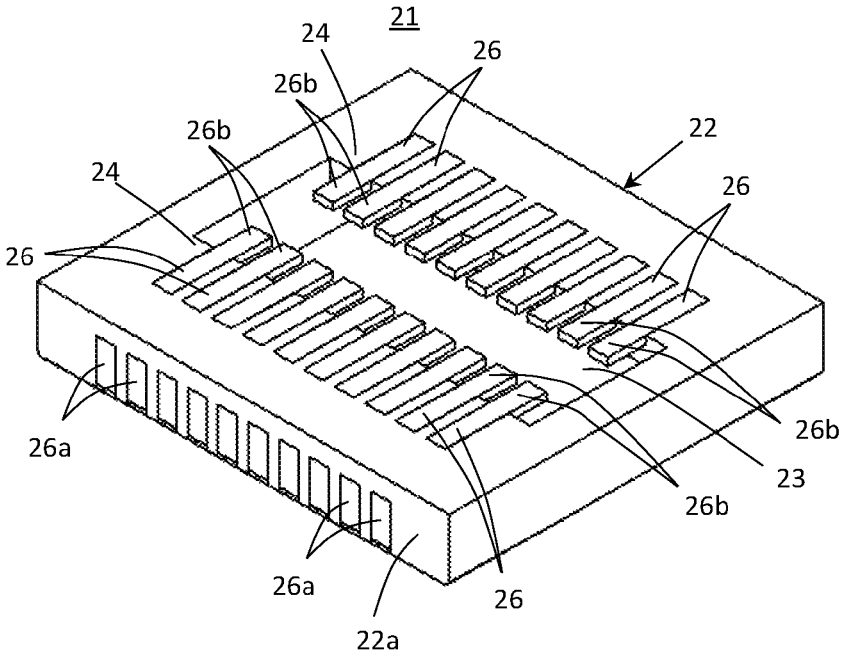
FIG. 6 is a schematic top perspective view showing a plug electrical connector included in the embodiment of circuit board connecting device according to the present invention.
Figure 7:
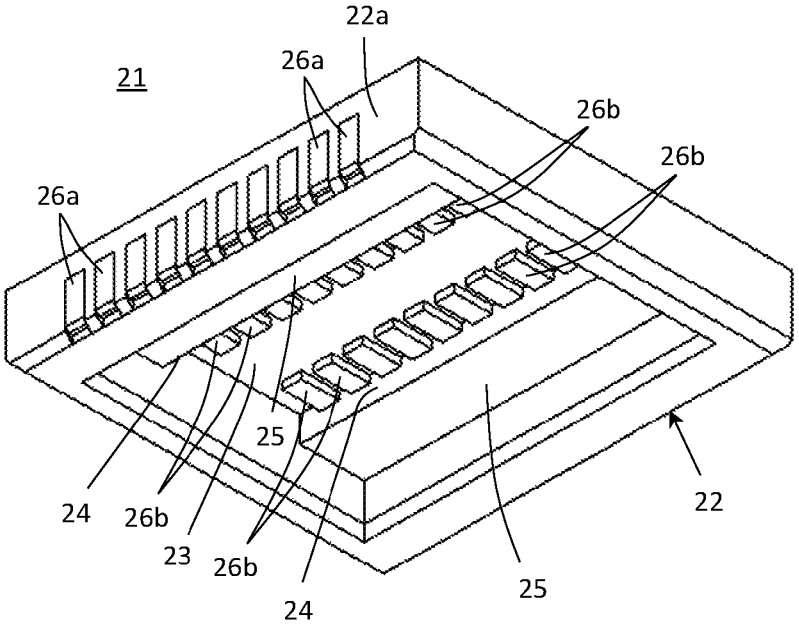
FIG. 7 is a schematic bottom perspective view showing the plug electrical connector included in the embodiment of circuit board connecting device according to the present invention.

Each of FIGS. 6 and 7 shows a plug electrical connector 21 which constitutes a second electrical connector included, together with the receptacle electrical connector 11, in the embodiment of separate circuit board connecting device according to the present invention.

Referring to FIGS. 6 and 7, the plug electrical connector 21 has a housing 22 made of insulating material such as plastics or the like to constitute a second housing. The housing 22 is formed to have a rectangular external shape to be put wholly in the engaging recess 13 provided on the housing 12 of the receptacle electrical connector 11 so as to engage with the engaging recess 13. A rectangular through hole 23 is formed on a central portion of the housing 22 to constitute a second through hole and a pair of recess forming portions 24 are provided on the housing 22 to be opposite to each other in such a manner that the rectangular through hole 23 is formed between the recess forming portions 24. A contacting face portion 25 is formed on each of the recess forming portions 24 to constitute a second contacting face portion.

The plug electrical connector 21 has also a plurality of signal contacts 26 fixed to the housing 22 to constitute a plurality of second signal contacts. The signal contacts 26 are divided into third and fourth groups and the signal contacts 26 belonging to each of the third and fourth groups are arranged on the housing 22 along a single direction.

Each of the signal contacts 26 is made of resilient conductive material to have a contacting portion 26*a* constituting a second contacting portion, a board connecting portion 26*b* constituting a second board connecting portion, and a fixable portion 26*c* (shown in FIG. 13) provided between the contacting portion 26*a* and the board connecting portion 26*b*. The contacting portion 26*a* of each of the signal contacts 26 is attached to an outer surface 22*a* of the housing 22, the board connecting portion 26*b* projects from one of four sides of the rectangular through hole 23 formed between the recess forming portions 24 to be put in the rectangular through hole 23, and the fixable portion 26*c* buried in the recess forming portion 24 provided on the housing 22 to be fixed to the recess forming portion 24. Accordingly, the board connecting portion 26*b* of each of the signal contacts 26 belonging to the third group and the board connecting portion 26*b* of each of the signal contacts 26 belonging to the fourth group are positioned to be opposite to each other in the rectangular through hole 23.

Under such a condition, each of the signal contacts 26 is provided on the housing 22 so as not to have any part thereof projecting to the outside from the housing 22.

The plug electrical connector 21 constituted as described above is mounted on a separate circuit board to be put in practical use in the same manner as the receptacle electrical connector 11.

Figure 8:
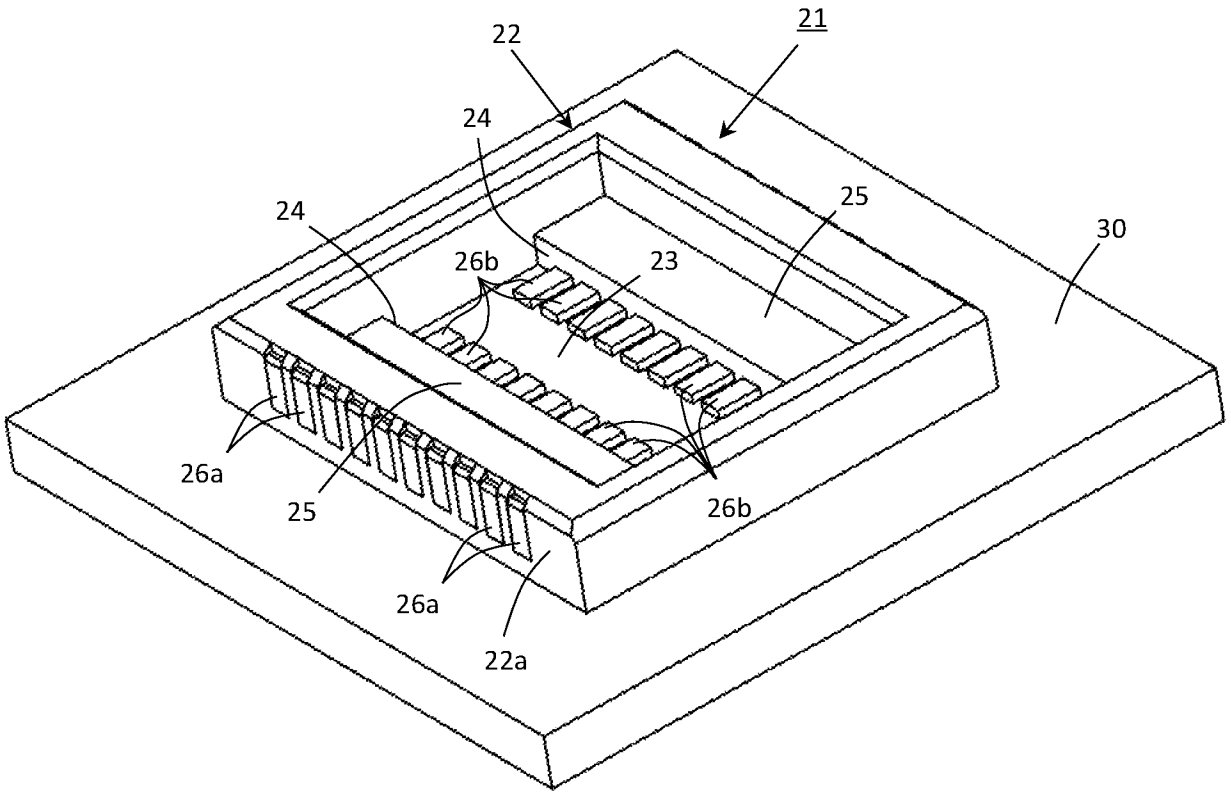
FIG. 8 is a schematic perspective view showing the plug electrical connector included in the embodiment of circuit board connecting device according to the present invention, together with a separate circuit board on which the plug electrical connector is mounted.
Figure 9:
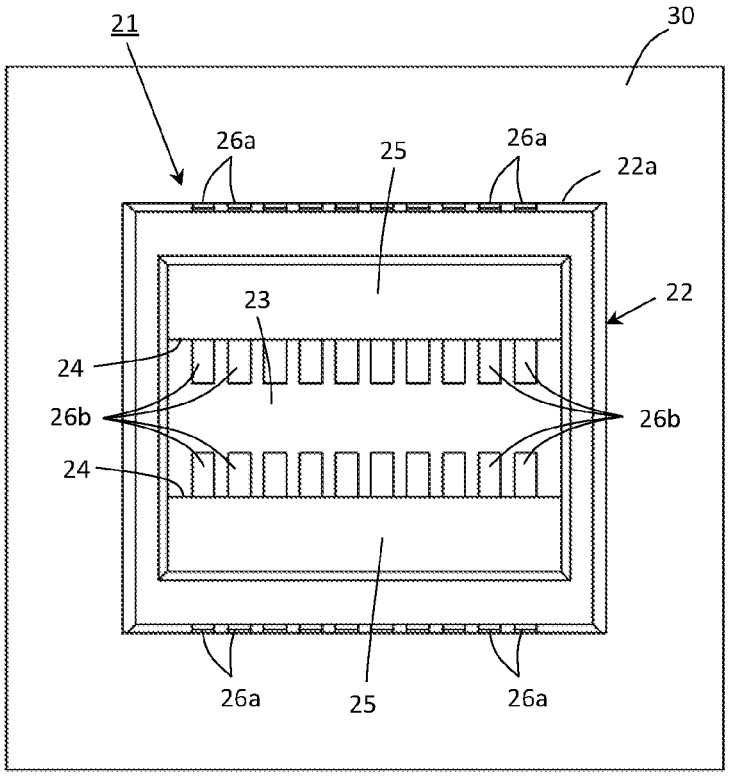
FIG. 9 is a schematic plan view showing the plug electrical connector included in the embodiment of circuit board connecting device according to the present invention, together with the separate circuit board on which the plug electrical connector is mounted.

Each of FIGS. 8 and 9 shows a condition wherein the plug electrical connector 21 is mounted on a separate circuit board 30 constituting a second separate circuit board. When the plug electrical connector 21 is in process of mounting on the separate circuit board 30, the housing 22 with the signal contacts 26 arranged thereon to be fixed is placed on the separate circuit board 30 in such a manner that the board connecting portion 26*b* of each of the signal contacts 26 positioned in the rectangular through hole 23 formed on the housing 22 is in contact with the separate circuit board 30 and then the board connecting portion 26*b* of each of the signal contacts 26 is connected with a signal terminal (not shown in the drawings) provided on the separate circuit board 30 by, for example, soldering in the rectangular through hole 23. With the board connecting portion 26*b* of each of the signal contacts 26 connected with the signal terminal provided on the separate circuit board 30 by, for example, soldering as described above, the plug electrical connector 21 on the whole is mounted on the separate circuit board 30 to be fixed to the same.

When the plug electrical connector 21 on the whole is fixed to the separate circuit board 30 as mentioned above, the soldering for connecting the board connecting portion 26*b* of each of the signal contacts 26 with the circuit terminal provided on the separate circuit board 30 is able to be conducted surely and easily through the rectangular through hole 23 formed on the housing 22 of the plug electrical connector 21.

The receptacle electrical connector 11 mounted on the separate circuit board 20 as shown in FIGS. 4 and 5 and the plug electrical connector 21 mounted on the separate circuit board 30 as shown in FIGS. 8 and 9 are coupled with each other in such a manner that the housing 22 of the plug electrical connector 21 is put in the engaging recess 13 provided on the housing 12 of the receptacle electrical connector 11 so as to engage with the engaging recess 13 and the receptacle electrical connector 11 and the plug electrical connector 21 coupled with the receptacle electrical connector 11 are put between the separate circuit boards 20 and 30 facing each other. As a result, the signal terminals provided on the separate circuit board 20 and the signal terminals provided on the separate circuit board 30 are electrically connected with each other through the signal contacts 17 of the receptacle electrical connector 11 and the signal contacts 26 of the plug electrical connector 21 so that the separate circuit boards 20 and 30 are put in mutual electrical connection.

Each of FIGS. 10 to 13 shows a condition wherein the plug electrical connector 21 is coupled with the receptacle electrical connector 11 and illustrations of the separate circuit boards 20 and 30 are omitted.

Figure 10:
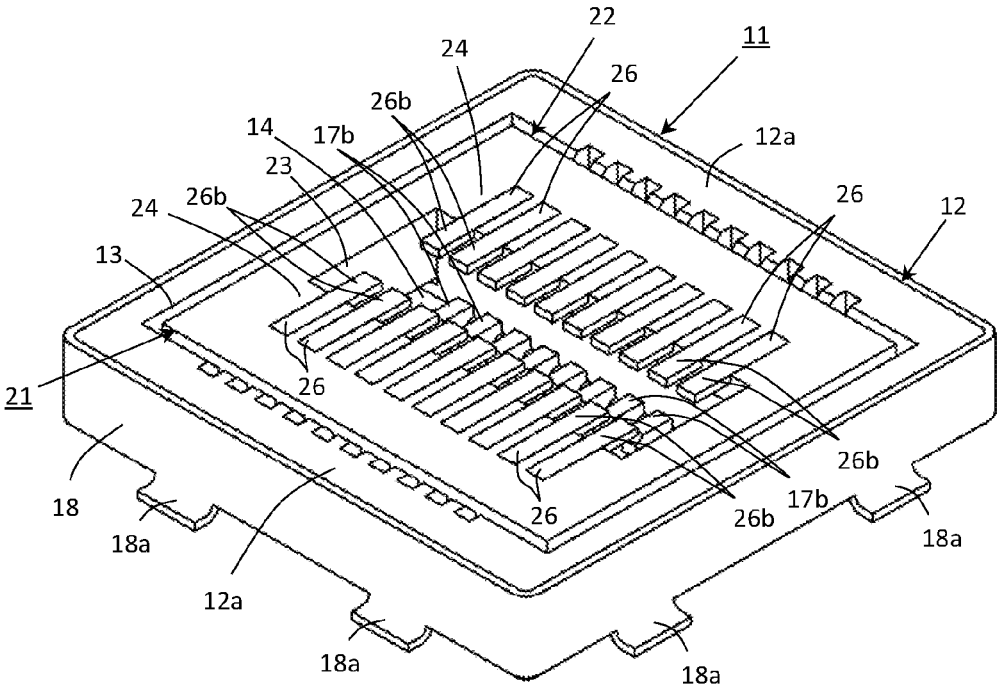
FIG. 10 is a schematic top perspective view showing a condition wherein the plug electrical connector included in the embodiment of circuit board connecting device according to the present invention is coupled with the receptacle electrical connector included in the embodiment of circuit board connecting device according to the present invention.
Figure 11:
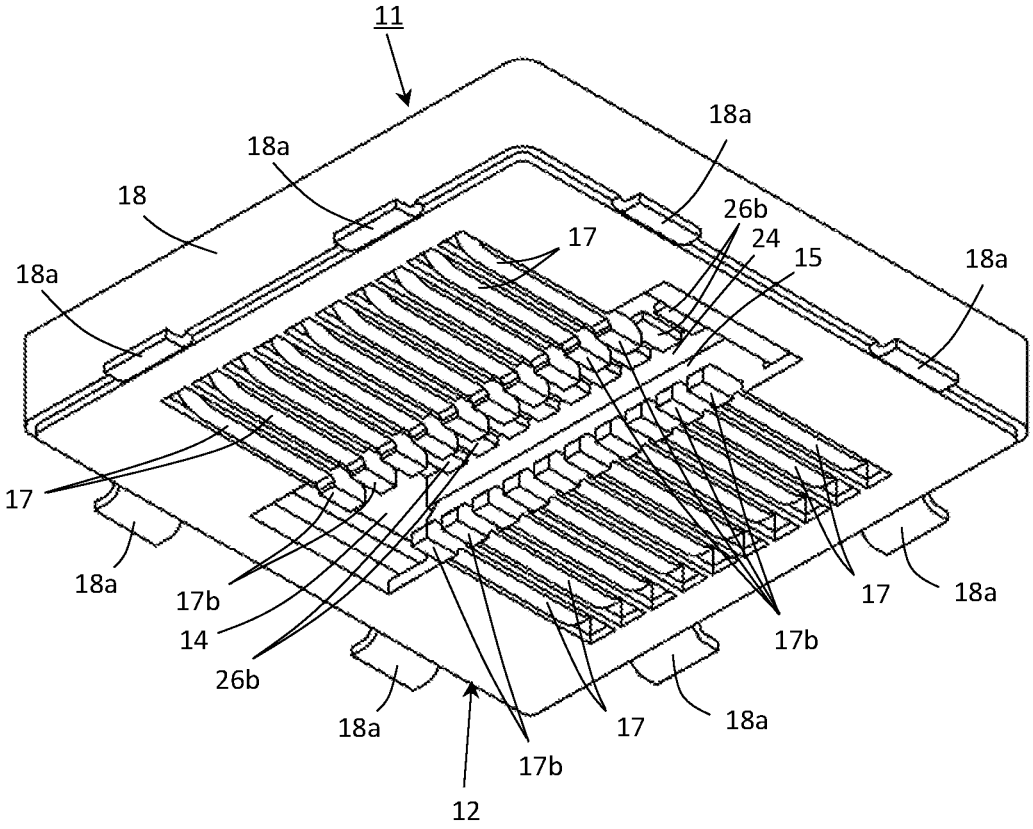
FIG. 11 is a schematic bottom perspective view showing the condition wherein the plug electrical connector included in the embodiment of circuit board connecting device according to the present invention is coupled with the receptacle electrical connector included in the embodiment of circuit board connecting device according to the present invention.
Figure 12:
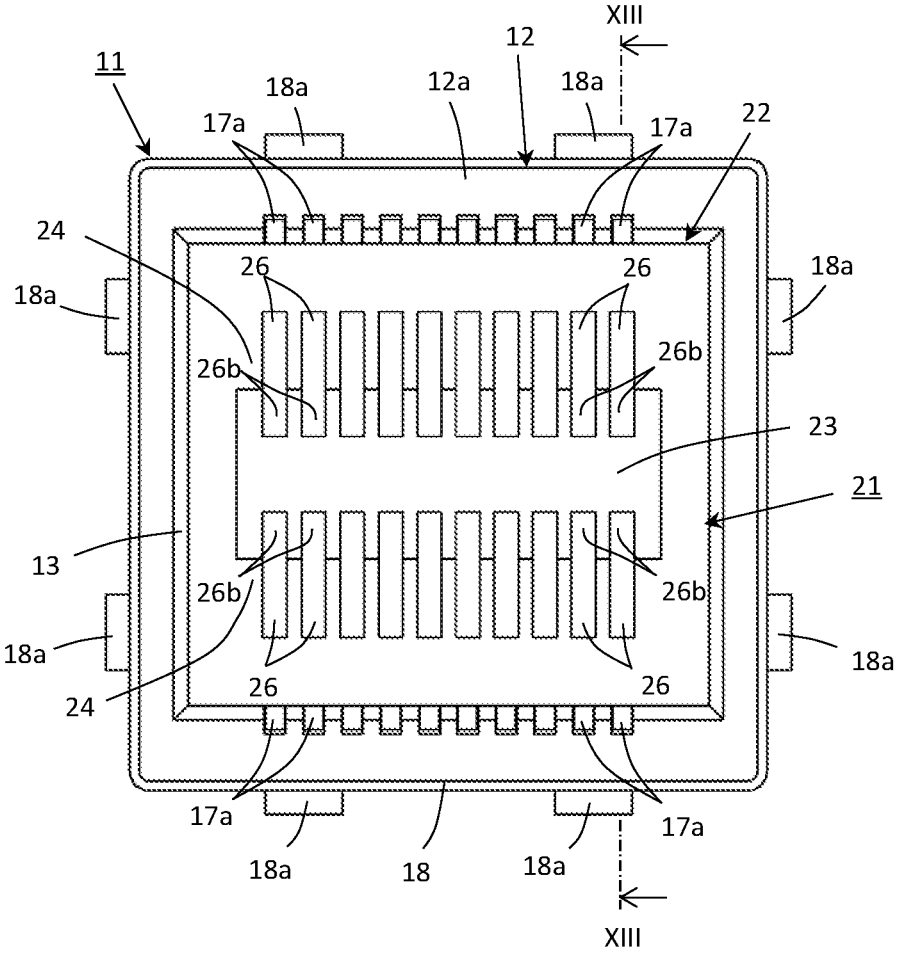
FIG. 12 is a schematic plan view showing the condition wherein the plug electrical connector included in the embodiment of circuit board connecting device according to the present invention is coupled with the receptacle electrical connector included in the embodiment of circuit board connecting device according to the present invention.

Referring to FIGS. 10 to 13, the housing 22 of the plug electrical connector 21 is put wholly in the engaging recess 13 formed in the recess forming portion 12*a* provided on the housing 12 of the receptacle electrical connector 11 so as to engage with the engaging recess 13 in such a manner that the board connecting portion 26*b* of each of the signal contacts 26 fixed to the housing 22 is set to face upwardly as shown in FIG. 10 and the contacting portion 26*a* of each of the signal contacts 26 of the plug electrical connector 21 attached to the outer surface 22*a* of the housing 22 is positioned to face the contacting portion 17*a* of a corresponding one of the signal contacts 17 of the receptacle electrical connector 11 placed in the recess forming portion 12*a* provided on the housing 12. Under such a situation, the signal contacts 17 of the receptacle electrical connector 11 and the signal contacts 26 of the plug electrical connector 21 are wholly put in the engaging recess 13 provided on the housing 12 of the receptacle electrical connector 11.

Figure 13:
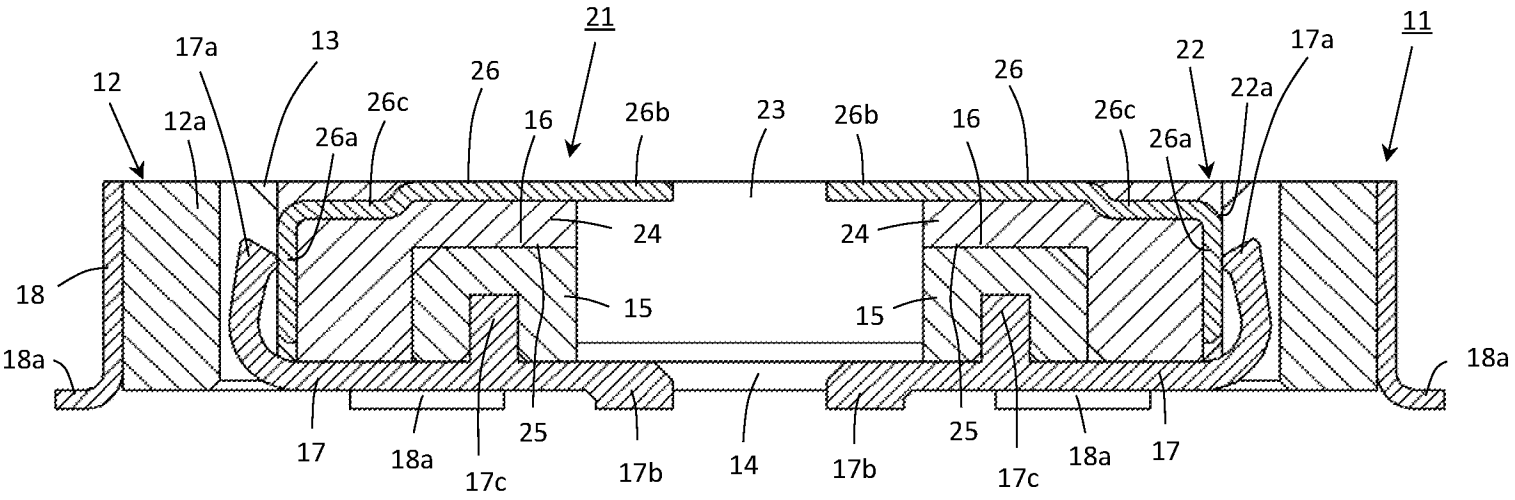
FIG. 13 is a schematic cross-sectional view taken along line XIII-XIII in FIG. 12.

Further, as shown in FIG. 13, the contacting face portion 16 provided on each of the protrusions 15 formed on the bottom portion 13*a* of the engaging recess 13 provided on the housing 12 to project from the bottom portion 13*a* into the engaging recess 13 is in contact with the contacting face portion 25 formed on each of the recess forming portions 24 provided on the housing 22 so as to restrict positional shifts of the contacting face portion 25, the contacting portion 26*a* of each of the signal contacts 26 is in contact with the contacting portion 17*a* of the corresponding one of the signal contacts 17 so that the signal contacts 17 of the receptacle electrical connector 11 and the signal contacts 26 of the plug electrical connector 21 are electrically connected with each other, and the signal contacts 17 of the receptacle electrical connector 11 and the signal contacts 26 of the plug electrical connector 21 are wholly surrounded by the conductive shell 18 which is provided for covering wholly the outer peripheral surface of the housing 12 surrounding the engaging recess 13. Therefore, the condition wherein the housing 22 of the plug electrical connector 21 is put wholly in the engaging recess 13 provided on the housing 12 of the receptacle electrical connector 11 so as to engage with the engaging recess 13 is maintained stably and the receptacle electrical connector 11 and the plug electrical connector 21 coupled with the receptacle electrical connector 11 are electromagnetically shielded enough by the conductive shell 18.

In the embodiment of circuit board connecting device according to the present invention which includes the receptacle electrical connector 11 and the plug electrical connector 21 as described above, when the housing 22 of the plug electrical connector 21 is put wholly in the engaging recess 13 provided on the housing 12 of the receptacle electrical connector 11 so as to engage with the engaging recess 13, the contacting portion 26*a* of each of the signal contacts 26 of the plug electrical connector 21 is in contact with the contacting portion 17*a* of the corresponding one of the signal contacts 17 of the receptacle electrical connector 11 and the signal contacts 17 of the receptacle electrical connector 11 and the signal contacts 26 of the plug electrical connector 21 on the whole are surrounded by the conductive shell 18 provided for covering wholly the outer peripheral surface of the housing 12 of the receptacle electrical connector 11 surrounding the engaging recess 13. Therefore, the signal contacts 17 and 26 having respectively the contacting portions 17*a* and 26*a* put in mutual contact-connection on the whole can be electromagnetically shielded enough with a relatively simple structure in which the conductive shell 18 is provided on the receptacle electrical connector 11 for covering wholly the outer peripheral surface of the housing 12 surrounding the engaging recess 13. This means that the receptacle electrical connector 11 mounted on the separate circuit board 20 and the plug electrical connector 21 mounted on the separate circuit board 30 can be electromagnetically shielded enough with the relatively simple structure.

The conductive shell 18 which functions as electromagnetic shielding means for the signal contacts 17 of the receptacle electrical connector 11 and the signal contacts 26 of the plug electrical connector 21 on the whole as mentioned above is incorporated with the receptacle electrical connector 11 so as to cover wholly the outer peripheral surface of the housing 12 surrounding the engaging recess 13. That is, the conductive shell 18 is not a discriminated member separated from the receptacle electrical connector 11. Therefore, when the receptacle electrical connector 11 is mounted on the separate circuit board 20, for example, such troublesome works as first to fix the housing 12 to the separate circuit board 20 and then to fasten the conductive shell 18 to the separate circuit board 20 are not required, and a process of working for mounting the receptacle electrical connector 11 on the separate circuit board 20 is prevented from being complicated and troublesome.

Further, the board connecting portion 17*b* of each of the signal contacts 17 of the receptacle electrical connector 11 is able to be connected with the signal terminal provided on the separate circuit board 20 by, for example, soldering conducted through the rectangular through hole 14 formed on the housing 12 of the receptacle electrical connector 11 and the board connecting portion 26*b* of each of the signal contacts 26 of the plug electrical connector 21 is also able to be connected with the signal terminal provided on the separate circuit board 30 by, for example, soldering conducted through the rectangular through hole 23 formed on the housing 22 of the plug electrical connector 21. Therefore, a total process of working for mounting the receptacle electrical connector 11 on the separate circuit board 20 and for mounting the plug electrical connector 21 on the separate circuit board 30 is able to be surely prevented from being complicated and troublesome.

As described above, with the embodiment of circuit board connecting device according to the present invention which includes the receptacle electrical connector 11 provided to be mounted on the separate circuit board 20 and the plug electrical connector 21 provided to be mounted on the separate circuit board 30, in a situation wherein the signal terminals provided on the separate circuit board 20, on which the receptacle electrical connector 11 is mounted, and the signal terminals provided on the separate circuit board 30, on which the plug electrical connector 21 is mounted, are put in mutual electrical connection, so that the separate circuit boards 20 and 30 are electrically connected with each other, the total process of working for mounting the receptacle electrical connector 11 on the separate circuit board 20 and for mounting the plug electrical connector 21 on the separate circuit board 30 is able to be prevented from being complicated and troublesome, and the receptacle electrical connector 11 and the plug electrical connector 21 are able to be electromagnetically shielded enough with the relatively simple structure.

The invention claimed is:

1. A circuit board connecting device for putting first and second separate circuit boards in mutual electrical connection comprising;

a first electrical connector provided to be mounted on the first separate circuit board, said first electrical connector having a first housing provided thereon with an engaging recess with a bottom portion on which a first through hole is formed, a plurality of first signal contacts provided on the first housing, each of which has a first contacting portion fixed to a recess forming portion of the first housing in which the engaging recess is formed and a first board connecting portion put in the first through hole to be connected with the first separate circuit board, and a conductive shell provided for covering wholly an outer peripheral surface of the first housing surrounding the engaging recess; and a second electrical connector provided to be mounted on the second separate circuit board, said second electrical connector having a second housing provided thereon with a second through hole and operative to be put in the engaging recess provided on the first housing so as to engage with the engaging recess, and a plurality of second signal contacts provided on the second housing, each of which has a second contacting portion attached to an outer surface of the second housing and a second board connecting portion put in the second through hole to be connected with the second separate circuit board;

wherein when the second housing is put in the engaging recess provided on the first housing so as to engage with the engaging recess, the second contacting portion of each of the second signal contacts is in contact with the first contacting portion of a corresponding one of the first signal contacts and the first and second signal contacts are surrounded by the conductive shell.

2. A circuit board connecting device according to claim 1, wherein the first housing is provided with a first contacting face portion projecting from a bottom portion of the engaging recess into the engaging recess, the second housing is provided with a second contacting face portion formed on a recess forming portions for forming the second through hole, and the first contacting face portion is in contact with the second contacting face portion so as to restrict positional shifts of the second contacting face portion.

3. A circuit board connecting device according to claim 1, wherein the first signal contacts are arranged on the first housing along a first single direction and the second signal contacts are arranged on the second housing along a second single direction.

4. A circuit board connecting device according to claim 1, wherein the engaging recess is formed into a rectangular shape, the second housing is formed to have a rectangular external shape, the first contacting portion of each of the first signal contacts is provided on a part of the recess forming portion which constitute one of four sides of the engaging recess, and the second contacting portion of each of the second signal contacts is attached to a part of the rectangular external shape of the second housing.

5. A circuit board connecting device according to claim 1, wherein the first through hole provided on the first housing is formed into a rectangular shape, the second through hole provided on the second housing is formed into a rectangular shape, the first board connecting portion of each of the first signal contacts is provided to project from one of four sides of the first through hole formed into the rectangular shape to be put in the first through hole, and the second board connecting portion of each of the second signal contacts is provided to project from one of four sides of the second through hole formed into the rectangular shape to be put in the second through hole.

6. A circuit board connecting device according to claim 1, wherein the first signal contacts are divided into first and second groups, so that the first board connecting portion of each of the first signal contacts belonging to the first group and the first board connecting portion of each of the first signal contacts belonging to the second group are positioned to be opposite to each other in the first through hole, and the second signal contacts are divided into third and fourth groups, so that the board connecting portion of each of the second signal contacts belonging to the third group and the board connecting portion of each of the second signal contacts belonging to the fourth group are positioned to be opposite to each other in the second through hole.

* * * * *